United States Patent [19]

Nelson

[11] Patent Number: 4,727,962

[45] Date of Patent: Mar. 1, 1988

[54] MOVABLE SENSING APPARATUS

[75] Inventor: David E. Nelson, Peoria, Ill.

[73] Assignee: Caterpillar Inc., Peoria, Ill.

[21] Appl. No.: 913,835

[22] Filed: Sep. 29, 1986

[51] Int. Cl.[4] ..... B66F 9/24

[52] U.S. Cl. ..... 187/9 R; 187/28; 414/273; 414/674; 250/222.1

[58] Field of Search ..... 187/9 R, 9 E, 28; 414/273–275, 87, 674, 660–667; 250/222.1, 223 R; 901/47

[56] References Cited

U.S. PATENT DOCUMENTS

| | | | |
|---|---|---|---|
| 2,653,679 | 9/1953 | Hamilton, Jr. | 187/9 R |
| 3,672,470 | 6/1972 | Ohntrup | 187/1 |
| 3,824,020 | 7/1974 | Pease | 414/274 X |
| 4,130,183 | 12/1978 | Tjörnemark | 187/9 R |
| 4,279,328 | 7/1981 | Ahlbom | 187/9 |
| 4,526,502 | 7/1985 | Mitani | 414/664 X |
| 4,564,085 | 1/1986 | Melocik et al. | 187/9 R |

FOREIGN PATENT DOCUMENTS

| | | | |
|---|---|---|---|
| 708047 | 4/1965 | Canada | 187/9 R |

*Primary Examiner*—Joseph J. Rolla
*Assistant Examiner*—Nils E. Pedersen
*Attorney, Agent, or Firm*—Alan J. Hickman

[57] ABSTRACT

Movable sensing arrangements are prone to damage, unable to position a load engaging device relative to a load for stacking purposes, and unable to controllably position the sensing arrangement. A movable sensing apparatus having a housing and first and second signaling devices mounted in the housing is provided. A guide rail assembly elevationally movably mounts the housing on a carriage assembly and an actuator controllably elevationally moves the housing along the guide rail assembly. A coupling connects the actuator to the housing and releases the housing from connection with the actuator in response to a force of a preselected magnitude being applied to the housing. Thus, the problems related to damage, stacking, and positioning are reduced. The movable sensing apparatus is particularly suited for use on an automatic guided unmanned vehicle having a lift mast assembly.

23 Claims, 5 Drawing Figures

MOVABLE SENSING APPARATUS

TECHNICAL FIELD

This invention relates generally to an elevationally movable sensing apparatus and, more particularly, to an elevationally movable sensing apparatus for a lift mast assembly having a coupling for connecting a housing of the elevationally movable sensing apparatus to an output member of an actuator and for releasing the housing from connection with the actuator in response to a force of a preselected magnitude being applied to the housing.

BACKGROUND ART

Sensing arrangements are known which permit automatic alignment between the forks of a material handling vehicle, for example, an automatic guided vehicle of the driverless type, and a load to be lifted. Some examples of sensing arrangements of the optical type are shown in U.S. Pat. No. 3,672,470 dated June 27, 1972 to Frederick F. Ohntrup et al., and U.S. Pat. No. 4,279,328 to Sten H. N. Ahlbom dated July 21, 1981. Each of these patents utilize an optical system which enables the forks of the lift mast assembly to be elevationally positioned and aligned relative to a load to be lifted when the forks are empty. However, when the forks have a load supported thereon and the vehicle is in the process of unloading or stacking, the load carried by the forks does not enable automatic alignment between the stack upon which the load is to be deposited and the load itself. The optical sensing systems disclosed in the above-noted patents are intended for controlling the elevational position of the forks relative to the load to be lifted and not the position of the forks relative to the stack upon which it is to be placed. It would be inappropriate to utilize any of the above-noted sensing systems for load stacking since any load carried on the forks would interfere with delivery and receipt of the light signal. The position of the optical sensors shown in the above-identified patents is set to align the tip of the fork relative to the load to be engaged and therefore would not be properly positioned to identify the top of stack upon which the load is to be deposited.

U.S. Pat. No. 3,672,470 discloses the placement of an optical sensor at a location on and adjacent the tip of the lift fork. Often the environment in which the material handling vehicle operates is dirty, dusty and the like. This results over time in a build up of dirt on the optical sensors which adversely affects the reliability of the optical sensing system. This is particularly true of sensors located adjacent the tip of the load handling fork.

Because the optical sensors are mounted at exposed locations on the vehicle, the potential for damage caused by impact between the sensors and external objects and the like is considerable. The optical sensor disclosed in U.S. Pat. No. 3,672,470 is rigidly connected to the lift fork at a location closely adjacent the lift fork tip. In a normal loading operation, engagement between the fork tip and the load to be lifted is a common occurrence. Thus, the potential for damage to the optical sensor is clearly a strong possibility.

The optical sensor disclosed in the U.S. Pat. No. 4,279,328 is mounted on the carriage of the lift mast and elevationally movable relative the forks in response to the carriage being moved to ground level for lifting a load that is at rest on the ground surface. Since the optical sensor is not controllably elevationally movable independently of the position of the carriage, the optical sensor is below the forks at a lowered position during a major portion of a normal work cycle in order to be able to direct a signal and receive a reflection of the signal for fork alignment purposes with a load to be lifted. Therefore, the optical sensor is normally exposed and vulnerable to external forces which may cause damage to the optical sensors and vehicle down time. No provision is made to prevent excessive external forces from being applied to the optical sensor when the optical sensor is at the lowered operative position.

The present invention is directed to overcoming one or more of the problems as set forth above.

DISCLOSURE OF THE INVENTION

In one aspect of the present invention, a controllably movable sensing apparatus is provided. The controllably movable sensing apparatus includes a first signaling means for delivering a first signal and receiving a reflection of the first signal, a housing connected to the first signaling means, and a trackway means for guiding the housing along a preselected guide path between first and second elevationally spaced apart positions. An actuator having a body and an output member movably connected to the body and controllably movable between spaced apart positions relative to the body is provided for moving the housing between the first and second spaced apart positions, and a coupling means connects the output member to the housing and releases the output member from connection with the housing in response to an external force of a preselected magnitude being applied to the housing in a direction along the guide path.

In another aspect of the present invention, a lift mast assembly having a carriage assembly and a load engaging device mounted on the carriage assembly is provided. A guide rail assembly which is mounted on the carriage assembly guides a housing between elevationally spaced apart first and second positions in response to an output member of an actuator being controllably movable between spaced apart elevational positions relative to a body of the actuator. A first signaling means for delivering a first signal and receiving a reflection of the first signal is mounted in the housing and a coupling means connects the output member to the housing.

In yet another aspect of the present invention, a material handling vehicle having a lift mast assembly, a carriage assembly elevationally movably mounted on the lift mast assembly, and a pair of material handling forks mounted on the carriage assembly is provided. A guide rail assembly mounted on the carriage assembly at a location between the forks elevationally guides a housing along the guide rail assembly between a first position at which the housing is substantially elevationally located between a first end and heel portion of the fork and a second position at which the housing is substantially elevationally spaced from the first position and elevationally below the first end and heel portions of the fork. An actuator having a body mounted on the carriage assembly and an output member controllably movably connected to the body is provided for controllably moving the housing between said first and second positions. A coupling means is provided for connecting the output member to the housing and releasing the output member from connection with the housing in response to an external force of a preselected magnitude being applied to the housing in a direction substantially along the guide rail assembly. A first signaling means for delivering a first signal and receiving a reflection of the first signal is mounted at a preselected location in the housing, and a second signaling means for delivering a second signal and receiving a reflection of the second signal is mounted in the housing at a preselected location spaced from the first signaling means.

Because the movable sensing apparatus is controllably movable between the first and second elevational positions, the sensing apparatus will only be at the second position when required for top of load sensing and load stacking maneuvers. Therefore, the potential for damage to the movable sensing apparatus is reduced.

Since the coupling means releasably connects the actuator output member to the housing, the potential for damage to the housing, and for that matter the first and second signaling means mounted in the housing, is further reduced. The sensing apparatus will never see a vertical load greater than a preselected value because the housing is released and elevationally guided to a safe location when the load reaches the preselected value.

The controlled elevational mobility of the housing enables the first signaling means to be positioned at a proper elevational location relative to the load engaging forks so that automatic alignment of the forks with the load to be lifted may be achieved. Also, the controlled elevational mobility of the housing enables the second signaling means to be positioned at a proper elevational location relative to the forks so that automatic elevational positioning of the carriage relative to a stack upon which a fork carried load is to be placed may be accomplished. Thus, complete, accurate, and efficient load engagement and load stacking results.

BEST MODE FOR CARRYING OUT THE INVENTION

Figure 1:
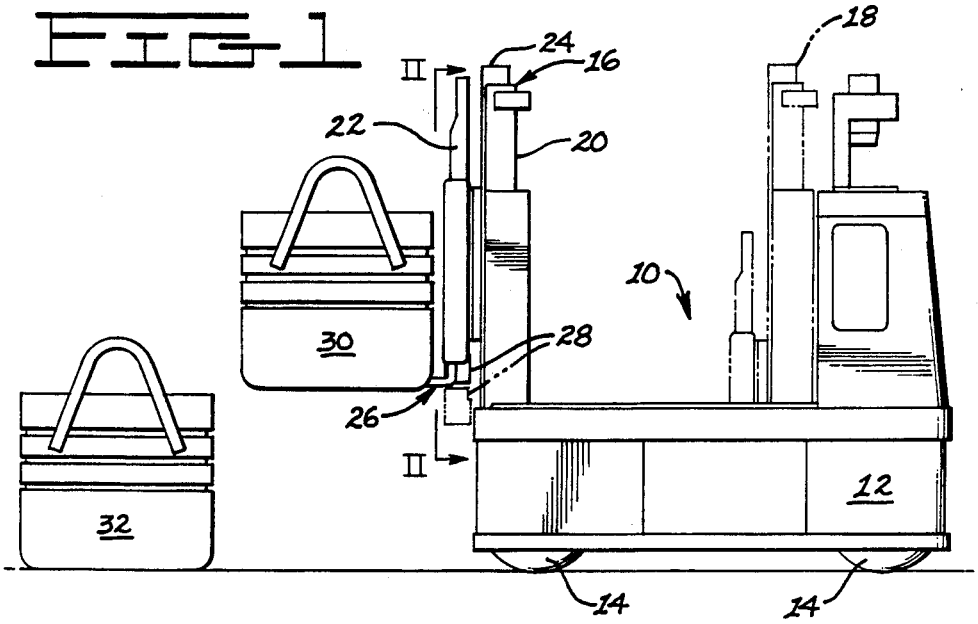
FIG. 1 is a diagrammatic side elevational view of an automatic guided vehicle of the stacker type showing a carriage assembly elevated on a lift mast assembly at a location for stacking a load, and showing a movable sensing apparatus in phantom lines at a second position.
Figure 5:
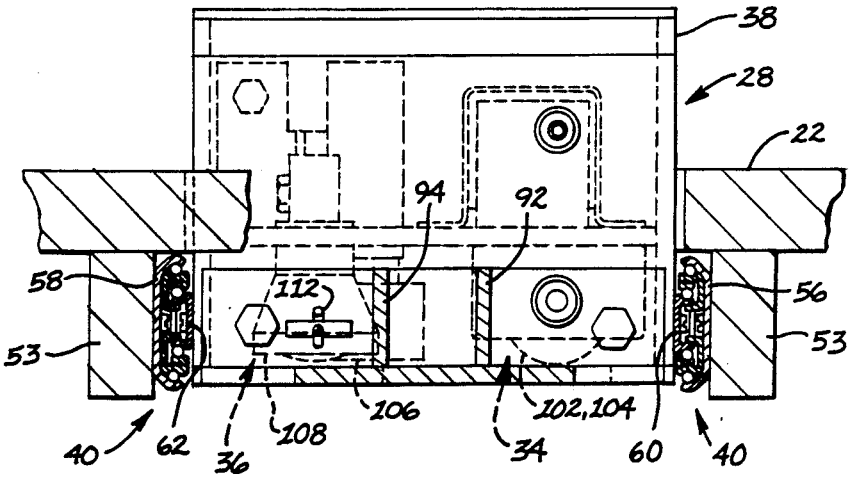
FIG. 5 is an enlarged diagrammatic sectional view taken along lines V—V of FIG. 2 showing first and second spaced apart fixed and movable guide rails of a trackway, a portion of the carriage assembly, the housing, in solid lines and first and second sensing means mounted in the housing in hidden lines.

With reference to the drawings, and in particularly FIG. 1, a material handling vehicle 10, shown as an automatic guided vehicle of the driverless load stacking type, has a frame 12 and a plurality of ground engaging wheels 14. A lift mast assembly 16 is mounted on the vehicle 10 and longitudinally movable on the vehicle 10 between a load carrying position 18, as shown in phantom lines, and a load lifting position 20, as shown in solid lines. The lift mast assembly 16 has a pair of spaced apart uprights 24. A carriage assembly 22 is mounted on and elevationally movable along the pair of spaced apart uprights 24 between elevationally spaced apart raised and lowered positions in a conventional manner. A load engaging device 26 is mounted on the carriage assembly 22 and extends therefrom in a direction longitudinal of the normal direction of travel of the vehicle 10. A movable sensing apparatus 28 is movably mounted on the carriage assembly 22. The material handling vehicle 10, as shown, is positioned to deposit a first load 30 on top of a second load 32 and in a stacking relationship therewith. The carriage assembly 22 is side shiftable; however, other types of carriage assemblies 22 are suitable substitutes and within the spirit of the invention. Since the carriage assembly 22 is a type well-known in the art, no further discussion related to the construction thereof will be addressed.

Figure 2:
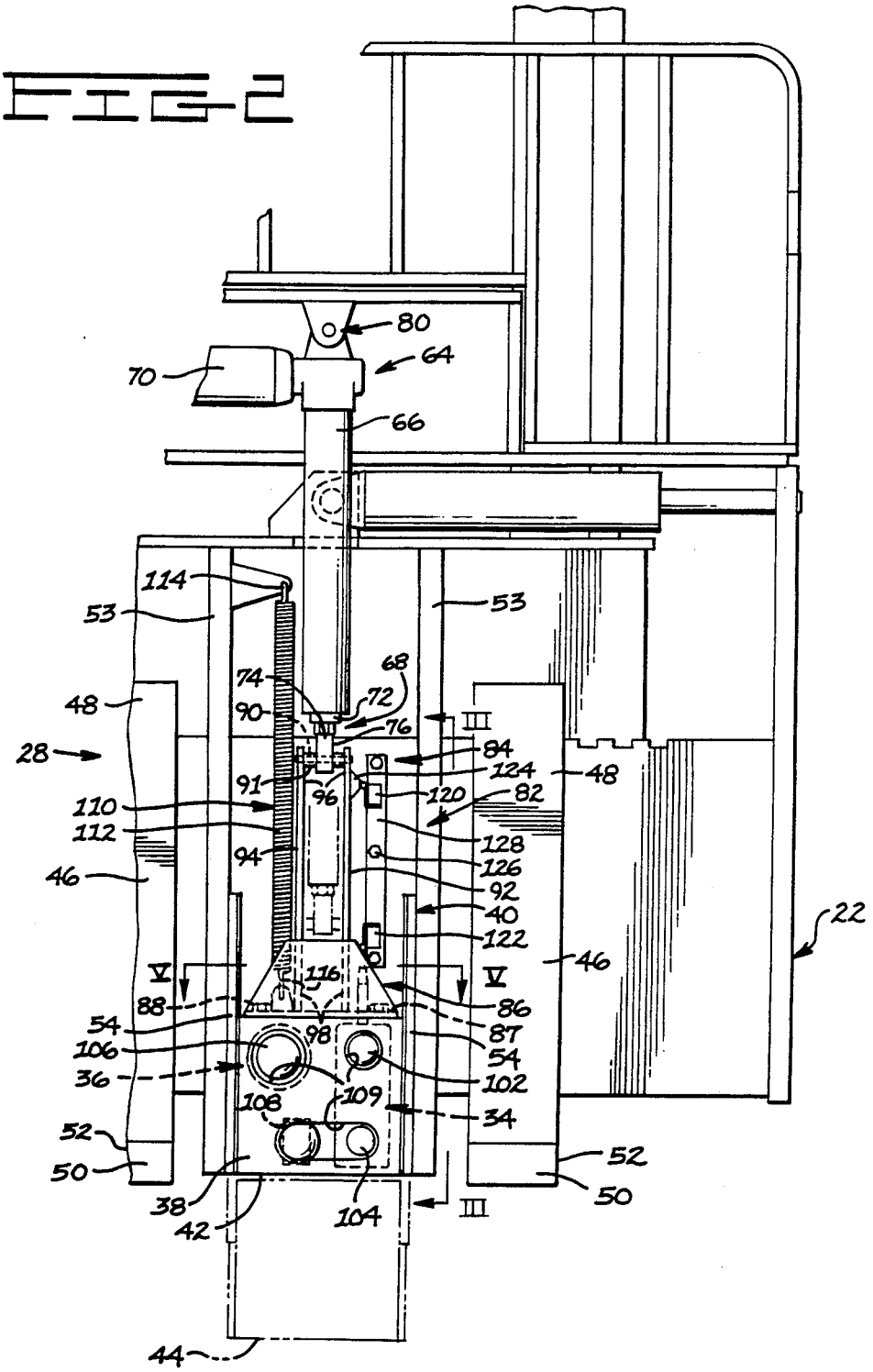
FIG. 2 is a diagrammatic front elevational view taken along lines II—II of FIG. 1 showing the carriage assembly, a load engaging device, and the movable sensing apparatus in greater detail, and showing a housing of the movable sensing apparatus at a first position in solid lines and at the second position in phantom lines.
Figure 3:
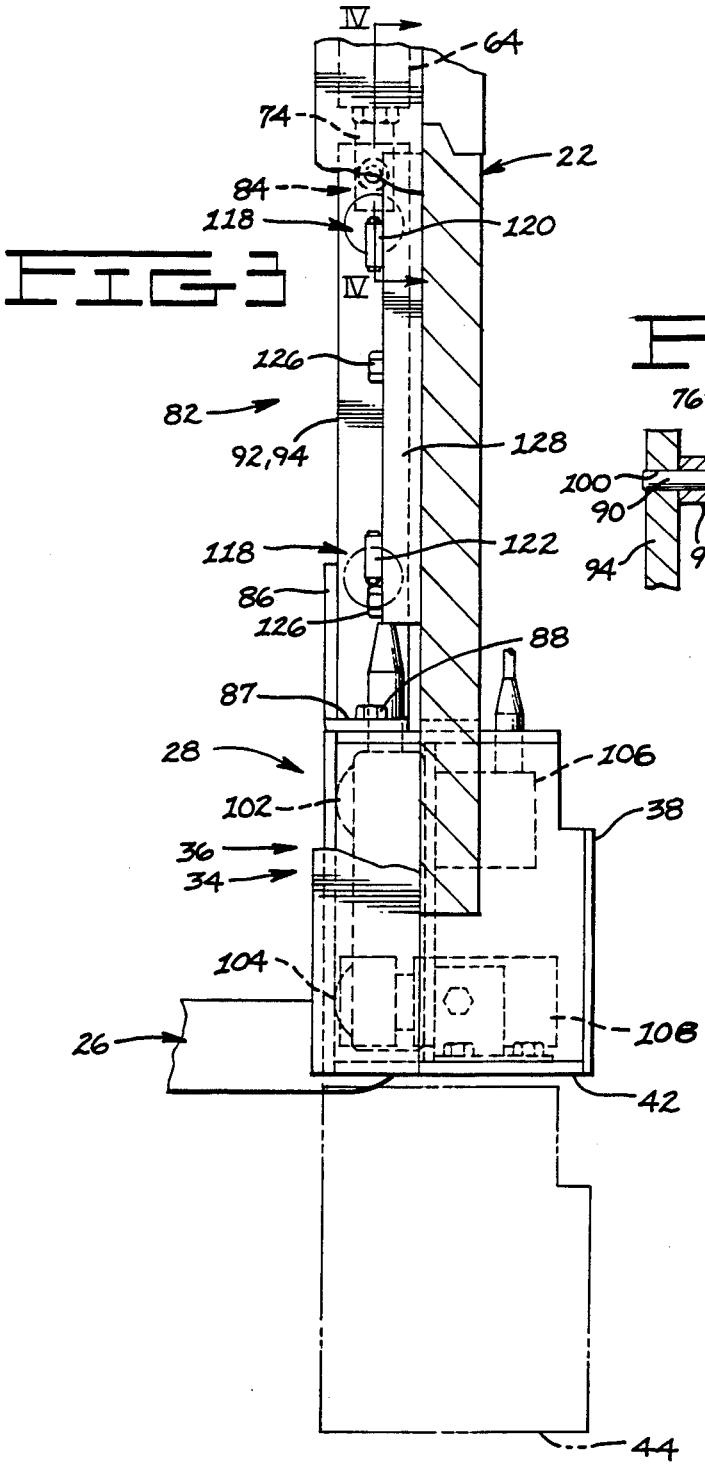
FIG. 3 is a diagrammatic side sectional view taken along lines III—III of FIG. 2 showing the carriage assembly and movable sensing apparatus in greater detail.

As best seen in FIG. 2, the movable sensing apparatus 28 includes first and second signaling means 34,36 for delivering first and second signals, respectively, and receiving a reflection of the first and second signals, respectively. The first and second signaling means 34,36 are each mounted in a housing 38 at spaced apart locations in the housing 38. The housing 38 is a box like structure having a plurality of sides with adequate space between its sides to accommodate the first and second signaling means 34,36 therein. Trackway means 40 is provided for guiding the housing 38 along a preselected guide path between first and second elevationally spaced apart positions 42,44 on the carriage assembly 22 and elevationally relative to the load engaging device 26. Preferably, the load engaging device 26 includes a pair of spaced apart material handling forks 46 each having first and second spaced apart end portions 48,50, and a heel portion 52 located between the first and second end portions 48,50. The forks' first end portions 48 are elevationally oriented and mounted on the carriage assembly 22 at transversely spaced apart locations on the carriage assembly 22. The forks' second end portions 50 extend from the carriage assembly 22 in a direction transverse the uprights 24 and longitudinal of the direction of travel of the vehicle 10. The housing 38 is mounted on the carriage assembly 22 at a location between the pair of forks 46.

The trackway means 40 includes a guide rail assembly 54 which is mounted on a pair of substantially parallel spaced apart elevationally oriented flanges 53 of the carriage assembly 22 at a location between the forks 48. The guide rail assembly 54 is elevationally oriented and the housing 38 is connected to the guide rail assembly 54 and elevationally movable along the guide rail assembly 54 between the first position 42 at which the housing 38 is substantially elevationally located between the forks' first end and heel portions 48,52, and the second position 44 at which the housing 38 is elevationally spaced from the first position 42 and substantially elevationally below the forks' first end and heel portions 48,52. The guide rail assembly 54 preferably includes first and second spaced apart fixed 2 guide rails 56,58 mounted on the carriage assembly 22, and first and second spaced apart movable guide rails 60,62 connected to the housing 38 and nested between the first and second fixed guide rails 56,58, respectively. The first and second movable guide rails 60,62 are elevationally movable along the first and second fixed guide rails 56,58. The first and second fixed and movable guide rails 56,58,60,62 guide the housing 38 for movement along a substantially straight elevational path substantially parallel to the forks first end portions 38 and the flanges 53, and between the first and second elevational positions 42,44 of the housing 38.

The movable sensing apparatus 28 includes an actuator 64 having a body 66, an output member 68 movably connected to the body 66, and an electric motor 70 mounted on the body 66 and drivingly connected to the output member 68. Although the actuator 64 intended for use herein utilizes an electric motor 70, which is mechanically coupled to the output member 68, other embodiments such as hydraulic motors and the like would be suitable replacements and considered within the scope of the invention. An example of a suitable actuator for use herein is Duff-Norton electromechanical actuator Model Number MPD6405-12. The output member 68 preferably includes a cylindrical rod portion 72 which is slidably disposed in the body 66 and longitudinally movable relative to the body 66. A first end portion 74 of the output member 68 includes an eye portion 76 having an aperture 78 (FIG. 4) disposed therein. The actuator 64 is mounted on the carriage assembly 22 in any acceptable, suitable manner. Preferred, however, is a pivotal mounting which utilizes a clevis and pin arrangement 80 of any suitable type known in the art. It should be noted that the body 66 is connected to the carriage 22 at an end portion of the body 66 opposite the eye 76. The electric motor 70 is connected to a control unit (not shown) mounted on the vehicle 10 which selectively directs electrical current to the motor 70. The control unit preferably includes a microprocessor (not shown) which controls the direction of movement of the output member 68 and the elevational position of apparatus 28 between elevational positions 42,44.

A coupling means 82 is provided for connecting the output member 68 to the housing 38. Preferably, the coupling means 82 includes a releasing means 84 for releasing the output member 68 from connection with the housing 38 in response to an external force of a preselected magnitude being applied to the housing 38 in a direction substantially along the guide rail assembly 54.

The coupling means 82 includes a bracket 86 having a base portion 87. The base portion 87 is mounted on housing 38 by fasteners 88. The releasing means 84 includes a pin 90 connected to and between the bracket 86 and the output member first end portion 74. The bracket 86 has first and second substantially parallel spaced apart side members 92,94 and first and second spaced apart end portions 96,98 on each of the first and second side members 92,94. The second end portions 98 of the side members 92,94 are connected to the base portion 87 and extend therefrom in an elevational direction substantially parallel to the guide rail assembly 54. An aperture 100 is disposed in the first end portion 96 of each of the first and second side members and adapted to receive pin 90 therein. The output member first end portion 74 is disposed between the first and second side members 92,94, and the pin 90 is disposed in apertures 78,100. The pin 90 pivotally connects the output member first end portion 74 to the first and second bracket side members 92,94 and is adapted to shear in response to the previously mentioned external force of the preselected magnitude being applied to the housing 38 in the direction substantially along the guide rail assembly 54. Therefore, any excessive load capable of damaging the housing 38 and/or the first and second signaling means 34,36 is sufficient to cause the pin 90 to shear and allow the housing to move from the second position 44 to the first position 42 and protect the housing 38 and signaling means 34,36 from damage. It is to be noted that the shear pin descibed herein is only one of several embodiments of the releasing means 84 and that other embodiments capable of releasing the housing from connection with the output member such as catches and mechanisms are considered within the spirit of the invention.

Figure 4:
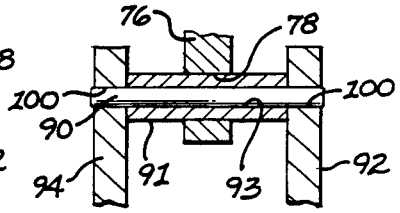
FIG. 4 is a diagrammatic cross-sectional view taken along lines IV—IV of FIG. 3 showing a coupling means for connecting an output member of an actuator to the housing.

As best seen in FIG. 4, the pin 90 is a cylindrically shaped configuration and is pressed in the apertures 100 of the first and second side members 92,94. Preferably, the pin is formed of a non-metallic material such as a low density polyethylene. A tubular sleeve 91, of preferably a mild steel, is disposed in the aperture 78 of eye portion 76 and between the first and second side members 92,94. The pin 90 is slidably disposed in an aperture 93 of the tubular sleeve 91 and extends past the ends of the tubular sleeve 91. It has been determined that the pin 90 should shear when the pin shear force is at least 50 lbs. When the pin shear force is less than 50 lbs., the vertical load on the housing 38 would not be sufficient to cause damage to the movable sensing apparatus 28.

A biasing means 110 is provided for urging the housing 38 toward the first position 42 and moving the housing to the first position 42 in response to the housing 38 being released from connection with the output member 68. The biasing means 110 is connected to and between the carriage assembly 22 and the housing 38. The biasing means 110 preferably is a linear spring 112 having first and second spaced apart end portions 114,116. The spring first end portion 114 is connected to the carriage assembly 22 in any suitable manner and the spring second end portion 116 is connected to the housing 38 in any suitable manner.

The first signaling means 34 includes a light beam source 102 which is mounted on the housing 38 at a preselected location, and a reflected light receiving phototransistor 104 whicn is mounted on the housing 38 at a preselected location elevationally spaced from the location of the light beam source 102. The elevational distance between the light beam source 102 and a reflected light receiving phototransistor 104 is a function of the scanning range desired, i.e., the intensity of the light beam and the angle at which the light beam is at relative to the reflected light receiving phototransistor. The first signaling means 34 is utilized to identify the top of the second load or stack 32 upon which the first load 30 is to be deposited so that the carriage assembly 22 and forks 46 may be positioned at the proper elevational level relative to the second load 32 to allow placement of the first load 30 on the second load 32.

The second signaling means 36 includes a source of illumination 106, for example, a sealed beam light, which is mounted at a preselected location on the housing 38, and a charge coupled device 108 which is mounted on the housing at a location elevationally spaced from the source of illumination 106. The source of illumination 106 is provided to light the surroundings so that the charge coupled device 108 may identify openings and the like in the load to be lifted for fork 46 positioning purposes. The housing 38 has a plurality of openings 109 of any suitable size and shape disposed therein. The openings 109 are positioned on the housing 38 at locations suitable for passing and receiving light signals from the first and second signaling means 34,36. Alternately, the portion of the housing 38 with the openings 109 disposed therein may be replaced by a transparent material such as plexiglas. This would eliminate the need for the openings 109.

A position sensing means 118 is provided for sensing the elevational position of the housing 38 and delivering a signal in response to the housing 38 being at one of the first and second elevational positions 42,44. As best shown in FIG. 2, the position sensing means 118 includes first and second micro switches 120,122 which are adjustably mounted on the carriage assembly 22 at elevationally spaced apart locations on the carriage assembly 22 closely adjacent the bracket first side member 92. A first projection 124 is mounted on the bracket first side member 92 at a preselected location. The first projection 124 is engageable with the first switch 120 at the first position 42 of the housing 38 and with the second switch 122 at the second position 44 of the housing 38. The first and second switches 120,122 establish the first and second elevational positions 42,44 of the housing 38 and deliver a signal in response to the housing being at the first and second positions 42,44. The signals from the first and second switches 120,122 inform the control unit (not shown) that the housing 38 is at the first and second positions 42,44 and the control unit in turn ceases actuation of the actuator 64. The first and second switches 120,122 are adjustably connected to the strip 128 which is fastened to the carriage assembly 22 by fasteners 126. Alternately, the actuator 64 may be equipped with sensing means 118 which would eliminate the need for mounting the first and second switches 120,122 as discussed. This is considered an equivalent and within the spirit of the invention.

INDUSTRIAL APPLICABILITY

With reference to the drawings, the movable sensing apparatus 28 enables the automatic guided vehicle 10 to accurately and automatically align the load engaging device 26 relative to the first load 30 to be lifted and to automatically align the load engaging device 26 relative to the second load 32 upon which the first load 30 is to be stacked.

The movable sensing apparatus 28 and particularly the housing 38 is moved to the first position 42 by retracting the output member 68 of the actuator 64 into the body 66 of the actuator 64. At the first position 42 of the housing 38, the first switch 120 delivers a control signal to the control unit telling the control unit that the housing 38 is at the first position 42. The control unit in turn responds to this signal and causes the actuator 64 to stop any further elevational movement of the housing 38. At the first position 42 of the housing 38, the second signaling means 36 is located at the proper elevational position relative to the load engaging device 26 so that the load engaging device 26 may be automatically elevationally positioned at a load engaging position with the bottom of the first load 30.

To lift a first load 30 that is resting on a surface such as the floor, the load engaging device 26 must be elevationally positioned at floor level to properly engage the first load 30. Because the housing 38 is at the first position 42, transversely between the forks 46 and elevationally above the forks second end portions 50, the potential for damage due to impact between an object, such as the floor, and the housing 38 is prevented. In the event that the housing 38 should remain elevationally beneath the forks second end portions 50 and a contact force between the housing 38 and the object should be at the preselected force, the releasing means 84 will release the housing from connection with the output member 68 and allow the housing to move along the guide rail assembly 54 to a safe unloaded position between the forks 46. A malfunction of the control unit, a binding of the guide rail assembly 54, or a malfunction of the actuator 64 are some examples of situations wherein the housing 38 may be undesirably located below the forks second end portions 50.

Upon successful engagement between the first load 30 and the load engaging device 26, the carriage assembly 22 is raised to a proper clearance height relative to the vehicle 10. The lift mast assembly 16 is then withdrawn to the load carrying position 18 and the carriage assembly 22 is lowered to an at rest position at which the first load 30 is supported on the vehicle 10. The vehicle 10 is then guided along a preselected path to a load deposit location at which the first load 30 is to be stacked upon the second load 32. As the vehicle 10 approaches the load deposit location, the carriage assembly 22 is raised to lift the first load 30 to the proper clearance height relative to the vehicle 10. The lift mast assembly 16 is then moved longitudinal of the vehicle 10 to the load lifting position 20, and the housing 38 is lowered by actuator 64 to the second position 44 at which the first signaling means 34 is clear of obstruction by the first load 30 carried on the forks 46. At the second position 44 of the housing 38, the first signaling means is substantially beneath the forks second end 50, at the preselected proper elevational position relative to the forks 46, and the projection 124 is engaged with switch 122.

The carriage assembly 22 is then automatically elevated until the first signaling means 34 identifies the top of the second load 32 and delivers a second signal to the control unit telling the control unit that the carriage is at an elevated position at which the forks 46 will clear the top of the second load 32. The control unit then ceases raising of the carriage assembly 22 and causes the actuator 64 to power the housing 38 to the first protected position 42. It should be noted that because the actuator 64 is selectively controllable, the housing 38 is disposed beneath the forks second end portion 50 for only a brief period of time and only when the first load is on the forks 46. The first load 30 is then moved to a position directly above the second load 32. The control unit then lowers the carriage assembly 22 until the first load 30 is supported on the second load 32 and free from being supported on the forks 46. The lift mast assembly 16 is then withdrawn to the load carrying position 18 and the carriage assembly 22 is lowered to the at rest position.

Thus, the movable sensing apparatus 28 eliminates the problems of damage to the housing 38 and first and second signaling means 34,36 by controllably and selectively moving the housing 38 to the first position whenever possible. Thus, the housing is only exposed a brief duration of time during a normal work cycle. Also, because the coupling means 82 includes releasing means 84, damage to the housing 38, first and second signaling means 34,36, actuator 64, and trackway means 40 will be substantially reduced.

Further, because the first and second signaling means 34,36 are provided in the manner previously discussed, the ability to align the forks 46 with the first load 30 to be lifted and to stack the first load 30 on the second load 32 is achieved in a simple, economical, and efficient manner.

Other aspects, objects and advantages of this invention can be obtained from a study of the drawings, the disclosure and the apended claims.

I claim:

1. A movable sensing apparatus for a lift mast assembly, comprising:

an elevationally movable carriage assembly;

a housing mounted on said carriage assembly;

first signaling means for delivering a first signal and receiving a reflection of said first signal, said first signaling means being connected to said housing;

trackway means for guiding said housing along a preselected guide path between first and second elevationally spaced apart positions relative to said carriage assembly;

an actuator having a body and an output member movably connected to said body, said actuator body being mounted on the carriage assembly and said output member being controllably movable between spaced apart positions relative to said body;

coupling means for connecting said output member to said housing and releasing said output member from said housing for movement relative to said carriage assembly along said guide path in response to an external force of a preselected magnitude being applied to said housing in a direction substantially along said guide path.

2. A movable sensing apparatus, as set forth in claim 1, wherein said trackway means includes:

first and second spaced apart fixed guide rails;

first and second spaced apart movable guide rails connected to the housing and nested between the first and second fixed guide rails, respectively, said first and second movable guide rails being movable along said first and second fixed guide rails, respectively.

3. A movable sensing apparatus, as set forth in claim 1, including a second signaling means for delivering a second signal and receiving a reflection of said second signal, said second signaling means being connected to said housing at a location on said housing spaced from said first signaling means.

4. A movable sensing apparatus, comprising:

a housing;

first signaling means for delivering a first signal and receiving a reflection of said first signal, said first signaling means being connected to said housing;

trackway means for guiding said housing along a preselected guide path between first and second elevationally spaced apart positions;

an actuator having a body and an output member movably connected to said body, said output member being controllably movable between spaced apart positions relative to said body;

coupling means for connecting said output member to said housing and releasing said output member from said housing in response to an external force of a preselected magnitude being applied to said housing in a direction substantially along said guide path;

biasing means for urging said housing toward said first position and moving said housing to said first position in response to said housing being released from connection with said output member.

5. A movable sensing apparatus, as set forth in claim 4, wherein said biasing means includes a spring connected to the housing.

6. A movable sensing apparatus, comprising:

a housing;

first signaling means for delivering a first signal and receiving a reflection of said first signal, said first signaling means being connected to said housing;

trackway means for guiding said housing along a preselected guide path between first and second elevationally spaced apart positions;

an actuator having a body and an output member movably connected to said body, said output member having a first end portion and being controllably movable between spaced apart positions relative to said body;

coupling means for connecting said output member to said housing and releasing said output member from said housing in response to an external force of a preselected magnitude being applied to said housing in a direction substantially along said guide path, said coupling means having a bracket connected to said housing and a pin connected to and between the bracket and the output member first end portion.

7. A movable sensing apparatus, as set forth in claim 6, wherein said pin being adapted to shear in response to said external force of said preselected magnitude being applied to said housing in said direction substantially along the preselected guide path defined by said trackway means.

8. A movable sensing appartaus, as set forth in claim 7, wherein said output member includes a cylindrical rod portion slidably disposed in said body, and said output member first end portion includes an eye portion, said output member aperture being disposed in said eye portion.

9. A movable sensing apparatus, as set forth in claim 6, wherein said bracket has first and second spaced apart side members, first and second spaced apart end portions on said first and second side members, and an aperture disposed in the first end portion of each of the first and second side members, said output member first end portion having an aperture, and said output member first end portion being disposed between the first and second side members, said pin being disposed in the aperture of the output member and said apertures in the first and second bracket side members.

10. A movable sensing apparatus, comprising:

a housing;

first signaling means for delivering a first signal and receiving a reflection of said first signal, said first signaling means being connected to said housing;

trackway means for guiding said housing along a preselected guide path between first and second elevationally spaced apart positions;

an actuator having a body and an output member movably connected to said body, said output member being controllably movable between spaced apart positions relative to said body, said actuator having an electric motor mounted on said body and being drivingly connected to said output member;

coupling means for connecting said output member to said housing and releasing said output member from said housing in response to an external force of a preselected magnitude being applied to said housing in a direction substantially along said guide path;

position sensing means for sensing the elevational position of said housing and delivering a signal in response to said housing being at one of said first and second elevational positions.

11. A movable sensing apparatus, as set forth in claim 10 wherein said position sensing means includes:

first and second elevationally spaced apart electrical switches; and a first projection mounted on said bracket, said first switch being engagable with the first projection at the first position of the housing and with the second switch at the second position of the housing.

12. A lift mast assembly, comprising:

a pair of spaced apart uprights;

a carriage assembly connected to said pair of uprights, said carriage assembly being movable along said pair of uprights between elevationally spaced apart raised and lowered positions;

a load engaging device having first and second spaced apart end portions and being connected at said first end portion to said carriage assembly;

a guide rail assembly mounted on said carriage assembly;

a housing connected to said guide rail assembly and movable along said guide rail assembly between a first position at which said housing is substantially elevationally located above the load engaging device second end portion and adjacent the first end portion, and a second position at which said housing is elevationally spaced from said first position and spaced substantially elevationally beneath said load engaging device second end portion;

first signaling means for delivering a first signal and receiving a reflection of said first signal, said first signaling means being connected to said housing;

an actuator having a body and an output member movably connected to said body, said body being mounted on said carriage assembly and said output member being controllably movable between elevationally spaced apart positions relative to said body; and coupling means for connecting said output member to said housing.

13. A lift mast assembly, as set forth in claim 12, wherein said coupling means includes means for releasing said output member from connection with said housing in response to an external force of a preselected magnitude being applied to said housing in a direction substantially along said guide rail assembly.

14. A lift mast assembly, as set forth in claim 13, including biasing means for urging said housing toward said first position and moving said housing to said first position in response to said housing being released from connecton with said output member, said biasing means being connected to and between the housing and said carriage assembly.

15. A lift mast assembly, as set forth in claim 13, wherein said output member has an eye portion having an aperture disposed therein, said coupling means including a bracket having an aperture disposed therein and being mounted on the housing, said releasing means including a pin and a sleeve having an aperture, said sleeve being disposed in the eye portion aperture and said pin being disposed in the apertures of the bracket and the sleeve, said pin being adapted to shear in response to said external force of said preselected magnitude being applied to said housing in said direction substantially along said guide rail assembly.

16. A lift mast assembly, as set forth in claim 13, wherein said guide rail assembly includes:

first and second spaced apart fixed elevationally oriented guide rails mounted on said carriage; and first and second spaced apart movable guide rails connected to said housing and movably mounted on said first and second spaced apart fixed guide rails, respectively.

17. A lift mast assembly, as set forth in claim 12, including position sensing means for sensing the elevational position of said housing and delivering a signal in response to said housing being at one of the first and second elevational positions.

18. A lift mast assembly, as set forth in claim 17, wherein said actuator body is pivotally connected to said carriage assembly, and said actuator includes an electric motor mounted on said actuator body and drivingly connected to said output member.

19. A lift mast assembly, as set forth in claim 12, including second signaling means for delivering a second signal and receiving a reflection of said second signal, said second signaling means being connected to said housing at a location on the housing spaced from the first signaling means.

20. A lift mast assembly, as set forth in claim 19, wherein said first signaling means includes:

a light beam source mounted on said housing at a preselected location; and a reflected light receiving phototransistor mounted on the housing at a preselected location elevationally spaced from the location of the light beam source.

21. A lift mast assembly, as set forth in claim 20, wherein said second signaling means includes:

a source of illumination mounted at a preselected location on said housing; and a charge couple device mounted on said housing at a location elevationaly spaced from said source of illumination.

22. A material handling vehicle, as set forth in claim 20, wherein said coupling means includes a pin connected to and between the housing and the output member, said pin being adapted to shear in response to said external force of said preselected magnitude being applied to said housing in said direction substantially along said guide rail assembly.

23. A material handling vehicle, comprising:

lift mast assembly having a pair of spaced apart uprights;

a carriage assembly movably mounted on said pair of uprights, said carriage assembly being movable along said pair of uprights between elevationally spaced apart raised and lowered positions;

a pair of material handling forks each having first and second spaced apart end portions, and a heel portion located between said first and second end portions, said forks first end portions being elevationally oriented and mounted on said carriage assembly at transversely spaced apart locations on the carriage assembly, and said forks second end portion extending from said carriage assembly in a direction transverse the pair of uprights and longitudinal of the material handling vehicle;

a guide rail assembly mounted on said carriage assembly at a location between the pair of forks, said guide rail assembly being elevationally oriented;

a housing being connected to said guide rail assembly and elevationally movable along said guide rail assembly between a first position at which said housing is substantially elevationally located between the forks first end and the heal portions, and a second position at which said housing is substantially elevationally spaced from the first position and elevationally below the forks first end and heal portions;

first signaling means for delivering a first signal and receiving a reflection of said first signal, said first signaling means being connected to said housing at a preselected location on the housing;

second signaling means for delivering a second signal and receiving a reflection of said second signal, said second signaling means being connected to said housing at a location on said housing spaced from said first signaling means;

an actuator having a body and an output member movably connected to said body, said body being mounted on said carriage assembly, and said output member being extensibly movable between spaced apart positions relative to said stationary body; and a coupling means for connecting said output member to said housing and releasing said output member from said housing in response to an external force of a preselected magnitude being applied to said housing in a direction substantially along said guide rail assembly.

* * * * *